US007827697B2

(12) United States Patent
Lake

(10) Patent No.: US 7,827,697 B2
(45) Date of Patent: Nov. 9, 2010

(54) LOW FRICTION FOLDING KNIFE

(76) Inventor: Ronald W. Lake, 3360 Bendix Ave., Eugene, OR (US) 97401

( * ) Notice: Subject to any disclaimer, the term of this patent is extended or adjusted under 35 U.S.C. 154(b) by 581 days.

(21) Appl. No.: 11/657,229

(22) Filed: Jan. 23, 2007

(65) Prior Publication Data

US 2007/0169355 A1 Jul. 26, 2007

Related U.S. Application Data

(60) Provisional application No. 60/761,044, filed on Jan. 23, 2006.

(51) Int. Cl.
*B26B 1/04* (2006.01)

(52) U.S. Cl. ..... 30/159; 30/160

(58) Field of Classification Search ..... 30/159–161
See application file for complete search history.

(56) References Cited

U.S. PATENT DOCUMENTS

| | | | | |
|---|---|---|---|---|
| 2,820,291 | A * | 1/1958 | Philippar | 30/153 |
| 4,769,912 | A * | 9/1988 | Davis | 30/162 |
| 5,802,722 | A | 9/1998 | Maxey et al. | |
| 5,815,927 | A | 10/1998 | Collins | |
| 6,145,202 | A | 11/2000 | Onion | |
| 6,276,063 | B1 * | 8/2001 | Chen | 30/161 |
| 6,308,420 | B1 * | 10/2001 | Moser | 30/161 |
| 6,523,265 | B2 * | 2/2003 | Eickhorn | 30/161 |
| 6,591,504 | B2 | 7/2003 | Onion | |
| 6,834,432 | B1 * | 12/2004 | Taylor, Jr. | 30/161 |
| 7,305,768 | B2 * | 12/2007 | Hinderer | 30/161 |
| 7,562,454 | B2 * | 7/2009 | Steigerwalt et al. | 30/160 |
| 2004/0244205 | A1 * | 12/2004 | Linn et al. | 30/159 |
| 2005/0097755 | A1 * | 5/2005 | Galyean et al. | 30/161 |

* cited by examiner

*Primary Examiner*—Kenneth E. Peterson
(74) *Attorney, Agent, or Firm*—Tori G. Andrews

(57) ABSTRACT

A low friction folding knife has a blade with a distal end and a tang. The tang has a slot disposed in the thickness of the tang with a roller cam extending slightly outside of the perimeter of the tang and rotatably attached within the slot. There is a safety assembly disposed within the first outer handle that has a safety stud extending through a safety slot in the first outer handle for moving the safety assembly between a safe position and a safe off position. There is an adjustable bias element disposed between the first liner and the second liner. The adjustable bias element is positioned to assist the blade in exiting the blade slot.

16 Claims, 7 Drawing Sheets

Fig. 5
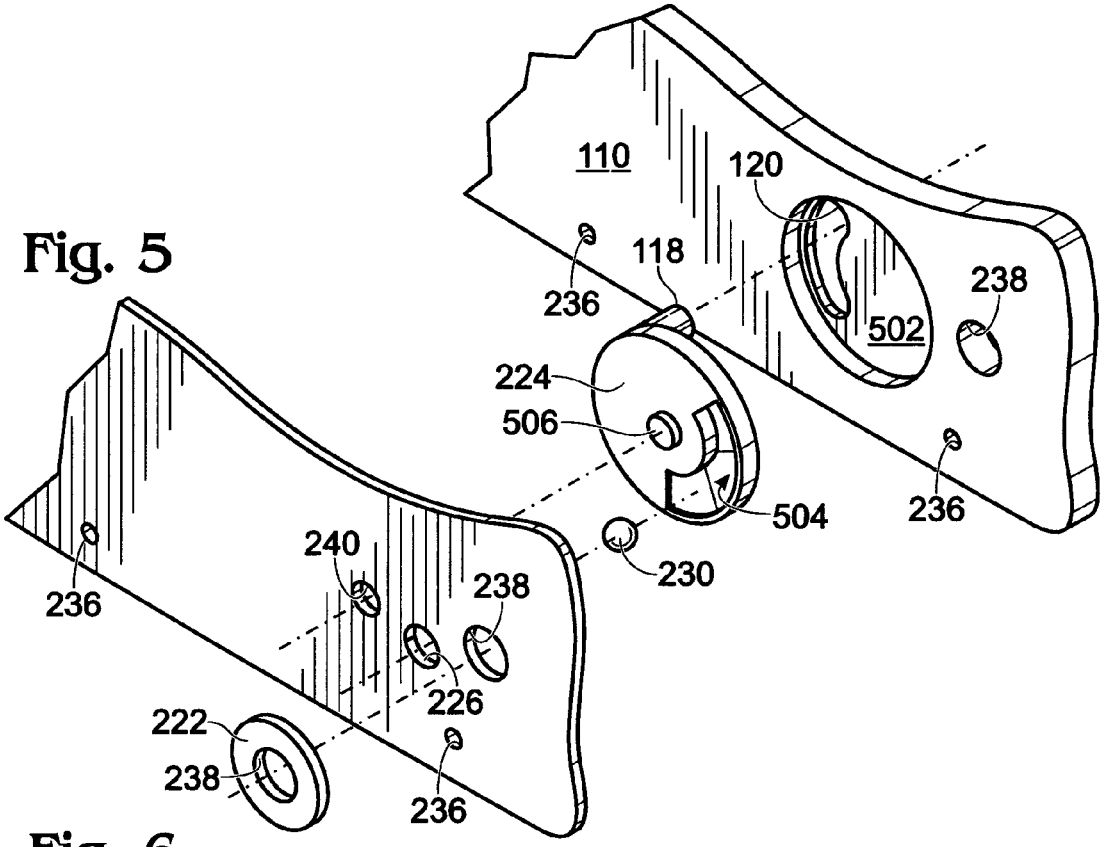
Fig. 6
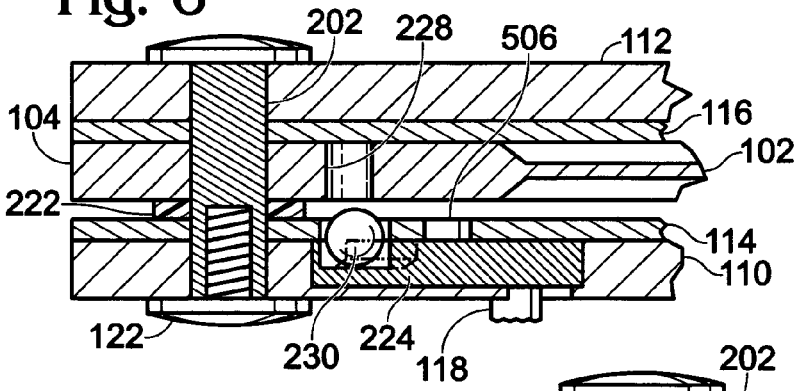
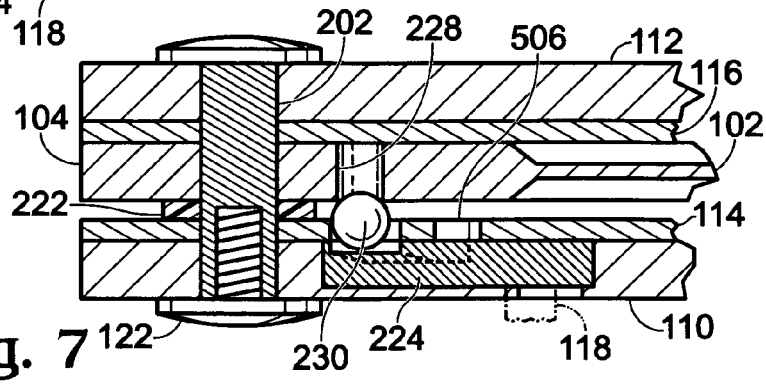
Fig. 7

LOW FRICTION FOLDING KNIFE

CROSS-REFERENCE TO RELATED APPLICATIONS

This application claims priority under 35 U.S.C. §119(e) to U.S. Provisional Application Ser. No. 60/761,044 entitled "Adjustable Spring—Low Friction Folding Knife" filed on Jan. 23, 2006, the entire disclosure of which is herein incorporated by reference for all purposes.

BACKGROUND OF THE INVENTION

1. Field of the Invention

This invention relates to a folding knife and, more particularly, to a low friction, assisted opening folding knife.

2. Prior Art

It has become somewhat common in the folding knife industry to have some type of assisted opening mechanism within the structure of the knife. Typically, these assisted opening mechanisms includes a spring that is in contact with or attached to the tang of the knife blade and affixed to the interior of the handle of the blade. An example of such an opening mechanism is disclosed in U.S. Pat. No. 6,145,202 issued to Onion. Onion discloses a mechanism located within the handle that communicates with the blade and provides positive assistance for opening and closing of the blade. The mechanism generally includes a bias element in communication with an arcuate slot in the tang of the blade. Each embodiment discloses a relatively complicated spring which would require precision bending while the arcuate slot required in the tang of the blade and the spring housing cavity in the handle would require precision machining. Additionally, the movement along the blade and in the arcuate slot will eventually cause galling, wear and friction on the blade.

Another example is U.S. Pat. No. 5,802,722 issued to Maxey et al. which discloses a similar spring mechanism that again travels within a slot in the tang of the blade. Over time the spring may require replacement or may no longer travel smoothly within the tang of the blade due to galling and wear making the knife either expensive to repair or useless with regard to the assisted opening feature.

There is a need for a folding knife that is safe, has an assisted opening feature, and is essentially frictionless. This folding knife must be thereby resistant to galling and wear, yet simplistic in design for cost effective manufacturing and assembly.

Objects and Advantages of the Present Invention

It is a primary object of the present invention to provide a folding knife that has low friction assisted or automatic opening.

It is another object of the present invention to provide a folding knife having a simplistic structure that allows for low cost manufacturing.

It is another object of the present invention to provide a folding knife that simplifies the production and assembly by having spring placement slots in the liners.

It is yet another object of the present invention to provide a folding knife having safety features that are complementary to the low friction automatic and semi-automatic opening mechanisms.

SUMMARY OF THE INVENTION

It is, therefore, the principal object of the present invention to provide a low friction folding knife that has an adjustable assisted opening feature with complementary safety devices that is simple in structure thereby minimizing production and assembly costs.

The present invention is a low friction folding knife which has a blade with a distal end and a tang. The tang has a slot disposed in the thickness of the tang with a roller cam extending slightly outside of the perimeter of the tang and rotatably attached within the slot. There is a handle with a first outer side parallel and attached to a first liner and a second outer side parallel and attached to a second liner. The first liner and the second liner are spaced apart and parallel leaving a blade slot for receiving the blade when the folding knife is in the closed position. The blade is pivotally attached to the handle with a pivot bolt. There is a safety assembly disposed within the first outer handle that has a safety stud extending through a safety slot in the first outer handle for moving the safety assembly between a safe position and a safe off position. The safety assembly in the safe position lodges a steel ball through a hole in the first liner and into a ball lock hole disposed through the tang of the blade thereby preventing opening of the blade. There is an adjustable bias element disposed between the first liner and the second liner. The adjustable bias element is positioned to assist the blade in exiting the blade slot. The adjustable bias element has an adjustment end and a spring distal end. The spring distal end is in spring communication with the roller cam on the tang. With the adjustable bias element adjusted to full extension it works as an automatic opening element by maintaining contact with and applying force to the roller cam in the tang of the blade forcing the opening of the blade. With the adjustable bias element adjusted to full contraction, the folding knife is in the assisted opening mode. The user must apply pressure to the opening stud to urge the blade from the closed position. As soon as the adjustable bias element is centered with the roller cam, the blade is forced to the fully open position by the spring force of the adjustable bias element on the roller cam.

BRIEF DESCRIPTION OF THE DRAWINGS

The above description and other objects, advantages, and features of the present invention will be more fully understood and appreciated by reference to the specification and accompanying drawings, wherein:

FIG. 5 is an exploded isometric view of the safety assembly of the preferred embodiment of the present invention.

FIG. 6 is a cross sectional view of the safety assembly of the preferred embodiment of the present invention at line 6-6 of FIG. 1 with the safety ball in the non-safe position.

FIG. 7 is cross sectional view of the safety assembly of the preferred embodiment of the present invention at line 6-6 of FIG. 1 with the safety ball in the safe position.

Figure 1:
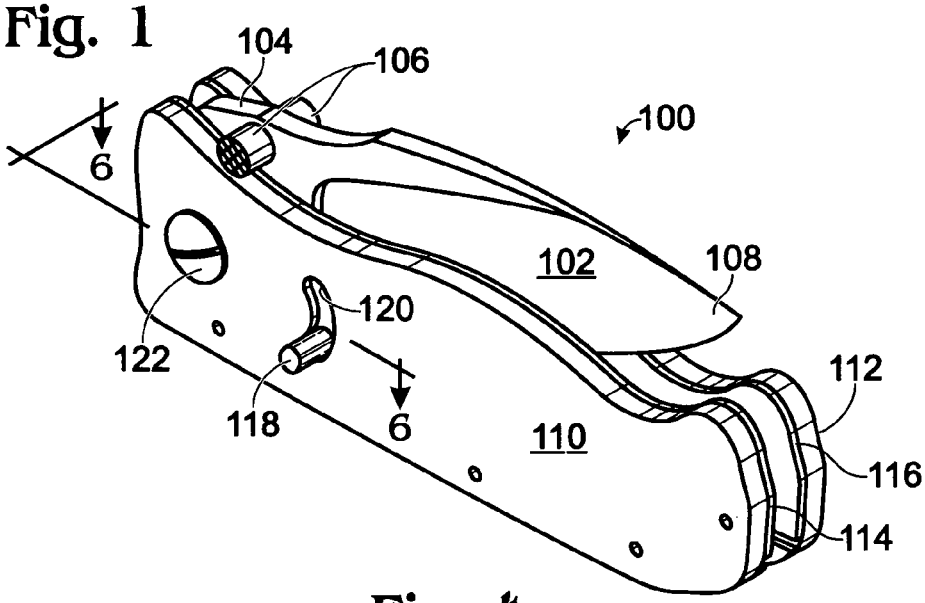
FIG. 1 is an isometric view of a folding knife according to the preferred embodiment of the present invention.

| DRAWINGS—Reference Numerals | |
|---|---|
| 100 | Folding Knife |
| 102 | Blade |
| 104 | Tang |
| 106 | Opening Stud |
| 108 | Distal End |
| 110 | First Outer Handle |
| 112 | Second Outer Handle |
| 114 | First Liner |
| 116 | Second Liner |
| 118 | Safety Stud |
| 120 | Safety Slot |
| 122 | Pivot Screw |
| 202 | Pivot Bolt |
| 204 | Safety Spring Portion |
| 206 | Safety Spring Slot |
| 208 | Elongated Slot |
| 210 | Adjustable Spring |
| 211 | Alternate Spring |
| 212 | Receiver Notch |
| 213 | Second Alternate Spring |
| 214 | Threaded Adjuster |
| 216 | Screw Driver Slot |
| 218 | Threaded Pillow block |
| 220 | Assembly Bolts |
| 222 | Spacer |
| 224 | Safety Washer |
| 226 | Passage Hole |
| 228 | Ball Lock Hole |
| 230 | Safety Ball |
| 232 | Spring Distal End |
| 234 | Spring Base |
| 236 | Assembly Holes |
| 238 | Pivot Bolt Hole |
| 240 | Safety Washer Pivot Hole |
| 242 | Spring Attach End |
| 244 | Lobe |
| 246 | Roller Cam |
| 248 | Keeper Pin |
| 250 | Safety Spring Portion End |
| 302 | Keeper Pin Holes |
| 304 | Roller Cam Slot |
| 502 | Safety Washer Recess |
| 504 | Incline Ramp |
| 506 | Safety Washer Pivot Pin |
| 804 | Semi-Auto Open Position |
| 806 | Auto Open Position |
| 1102 | Finger Cam |
| 1104 | Spring Locating Lug |
| 1106 | Finger Cam Clearance Offset |
| 1108 | Lug Slot |
| 1110 | Spring Cavity |
| 1112 | Safety Assembly |
| 1114 | Safety Stud Attach Point |
| 1116 | Bent Tab |
| 1118 | Slide Safety Engagement Notch |
| 1120 | Spring Safety Engagement Notch |
| 1122 | Bent Tab Notch |

-continued

| DRAWINGS—Reference Numerals | |
|---|---|
| 1124 | Safety Assembly Cavity |
| 1126 | Safety Engagement End |

DETAILED DISCUSSION OF THE PREFERRED EMBODIMENTS

Referring to the figures, like elements retain their indicators throughout the several views.

FIG. 1 is an isometric view of Folding Knife 100 according to the preferred embodiment of the present invention. Folding Knife 100 has a First Outer Handle 110, a First Liner 114, a Blade 102 that has a Tang 104 on one end and Distal End 108 on the opposite end. Distal End 108 is the tip of Blade 102. There is a Second Liner 116 followed by Second Outer Handle 112. Pivot Screw 112 screws into Pivot Bolt 202 (not shown) which both holds both halves of Folding Knife 100 together as well as allows Blade 102 to pivot between open and closed positions. Opening Stud 106 is attached to Tang 104 of Blade 102 and has a knurled outer surface for the thumb of the user to easily swing Blade 102 between open and closed. Opening Stud 106 is preferably knurled as shown in FIG. 1, but could be any surface or attached surface allowing grasping with the users thumb without slipping off during operation.

Safety Stud 118 is shown extending through Safety Slot 120 on First Outer Handle 110. There will be a detailed discussion of the safety assembly in the FIG. 2 discussion.

Figure 2:
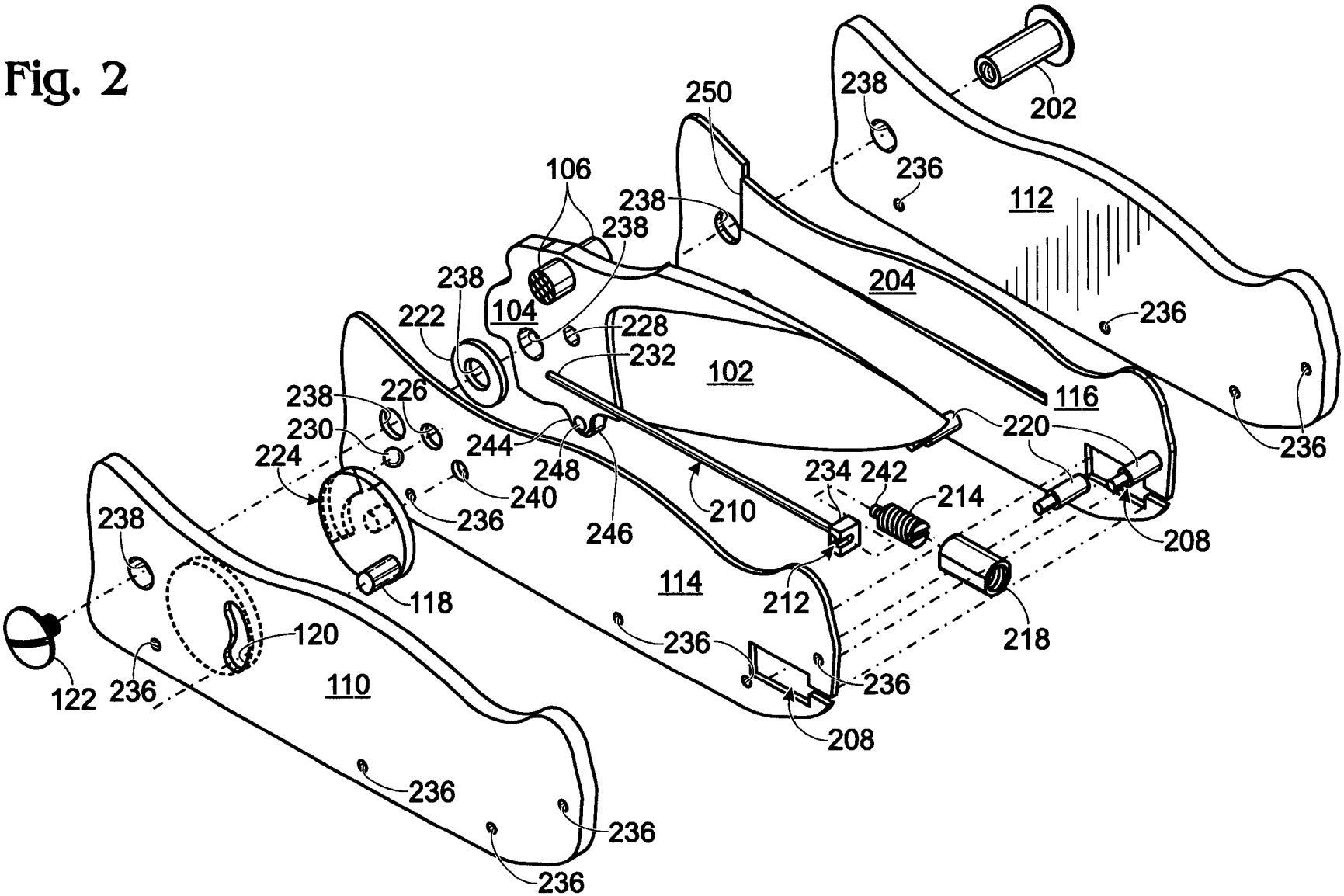
FIG. 2 is an exploded view of the folding knife of FIG. 1.

FIG. 2 is an exploded isometric view of Folding Knife 100 of FIG. 1. First Outer Handle 110, First Liner 114, Second Liner 116, and Second Outer Handle 112 are shown with Assembly Holes 236 dispensed around their perimeters. Assembly Bolts 220 are shown between First Liner 114 and Second Liner 116 and have outer lobes that are thinner than the body of Assembly Bolts 220. The outer lobes of Assembly Bolts 220 extend through First Liner 114 and First Outer Handle 110. The outer lobes on the opposite ends of Assembly Bolts 220 extend through Second Liner 116 and Second Handle 112. In the preferred embodiment, the ends of Assembly Bolts 220 are attached to First Outer Handle 110 and Second Outer Handle 112 by small screws (not shown) but can also be press fitted, glued or attached by any other means that will keep the assembly firmly attached. The larger, center portion of Assembly Bolts 220 function as spacers to give the correct space for Blade 102 when closed.

Safety Washer 224 lies within a recess (shown in phantom lines on First Outer Handle 110) with Safety Stud 118 extending through Safety Slot 120 in First Outer Handle 110. Safety Washer 224 is pivotally attached to First Liner 114 through Safety Washer Pivot Hole 240. Safety Ball 230 rides within an inclined ramp portion (shown in phantom on outer portion of Safety Washer 224)—the function of which will be discussed in detail within the FIG. 5 detailed discussion. Safety Ball 230 is preferably made of hardened tool steel, but could also be any other hard, wear-resistant metal, ceramic, or plastic. Passage Hole 226 for Safety Ball 230 is shown disposed through First Liner 114. When Blade 102 is in the locked position, Safety Ball 130 is forced through Passage Hole 226 and pressed firmly into Ball Lock Hole 228 in Tang 104 of Blade 102, locking Blade 102 in the closed position.

Spacer 222 is used to maintain a necessary space when Folding Knife 100 is assembled between First Liner 114 and Tang 104 of Blade 102. Pivot Bolt 202 extends through a Pivot Bolt Hole 238 on each Second Outer Handle 112, Second Liner 116, Tang 104, Spacer 222, First Liner 114, and First Outer Handle 110 holding the assembly firmly in place. Pivot Screw 122 holds Pivot Bold 202 in place. Although this assembly is shown in the preferred embodiment as a screw assembly, it could also be a press fitted assembly with the ends pressed into First Outer Handle 110 and Second Outer Handle 112.

Adjustable Spring 210 has a Spring Distal End 232 that is in contact with Roller Cam 246 located on Lobe 244 of Tang 104. Roller Cam 246 is secured within the shown slot on Lobe 244 with Keeper Pin 248. Roller Cam 246 is preferably made of hardened tool steel, but could also be any other hard, wear-resistant metal, ceramic or plastic. The opposite end of Adjustable Spring 210 has a larger portion, Spring Base 234, which has a Receiver Notch 212 that receives Spring Adjustment End 242 of Threaded Adjuster 214. Threaded Adjuster 214 threads into Threaded Pillow Block 218 to adjust Adjustable Spring 210 from the "automatic open" mode (Adjustable Spring 210 extended toward Tang 104) to the "assisted open" mode (Adjustable Spring 210 retracted away from Tang 104). This adjustment is done only with the knife in the closed position and using a screw driver in the Screw Driver Slot 216 located in the end of Threaded Adjuster 214 opposite Spring Adjustment End 242. Screw Driver Slot 216 is accessibly from the bottom of the handle—opposite Tang 104. First Liner 114 and Second Liner 116 each have an Elongated Slot 208 to accommodate the length and width of Threaded Pillow Block 218. Elongated Slot 208 holds Threaded Pillow Block 218 and Spring Base 234 in place so that only Threaded Adjuster 214 rotates during adjustment thereby extending or contracting Adjustable Spring 210. A detailed discussion of the functionality of Adjustable Spring 210 is forthcoming in the FIG. 8, FIG. 9, and FIG. 10 discussions.

Second Liner 116 has an open position Safety Spring Portion 204 that is created by Safety Spring Slot 206. Safety Spring Portion End 250 is biased toward Tang 104 such that when Folding Knife 100 is open, Safety Spring Portion End 250 automatically engages with the end of Tang 104 thereby locking Blade 102 in the extended or open position. When the user pushes Safety Spring Portion 204 out toward Second Outer Handle 112, Blade 102 can be pivoted back toward the folded or closed position.

Figure 3:
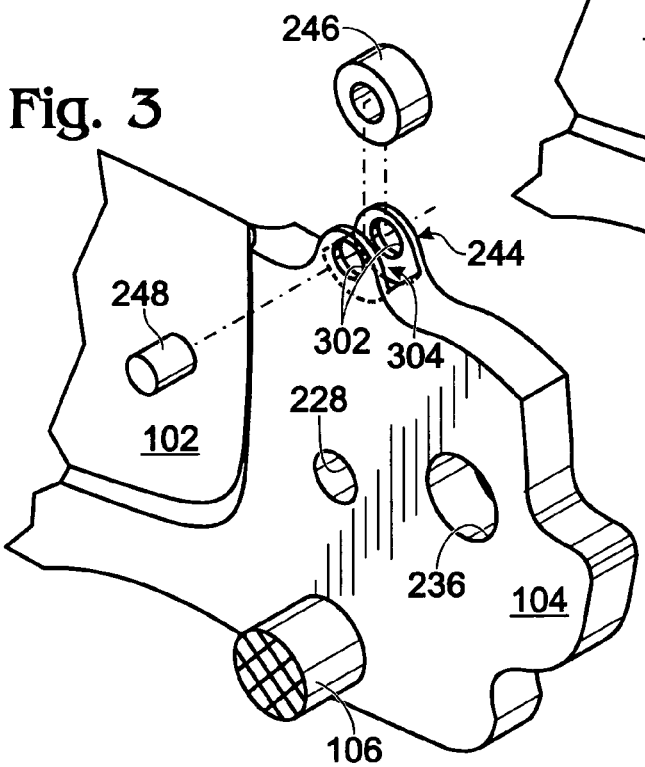
FIG. 3 is an exploded isometric view of the tang portion of the knife as shown in FIG. 1 depicting the insertion of the roller cam used for assisted opening of the knife.

FIG. 3 is an exploded isometric view of Tang 104 of FIG. 1 depicting the insertion of Roller Cam 246 into Roller Cam Slot 304 of Lobe 244. Roller Cam 246 is used for assisted or automatic opening of Folding Knife 100. Roller Cam Slot 304 is slightly wider than the width of Roller Cam 246 allowing Roller Cam 246 to fit within Lobe 244 with minimal side-to-side movement. Keeper Pin 248 slides though Keeper Pin Holes 302 located on both sides of Roller Cam Slot 304. In the preferred embodiment, Keeper Pin 248 is pressed into position, but could also be affixed by a screw or other means of holding Roller Cam 246 into position while still allowing it to roll freely within Roller Cam Slot 304.

Figure 4:
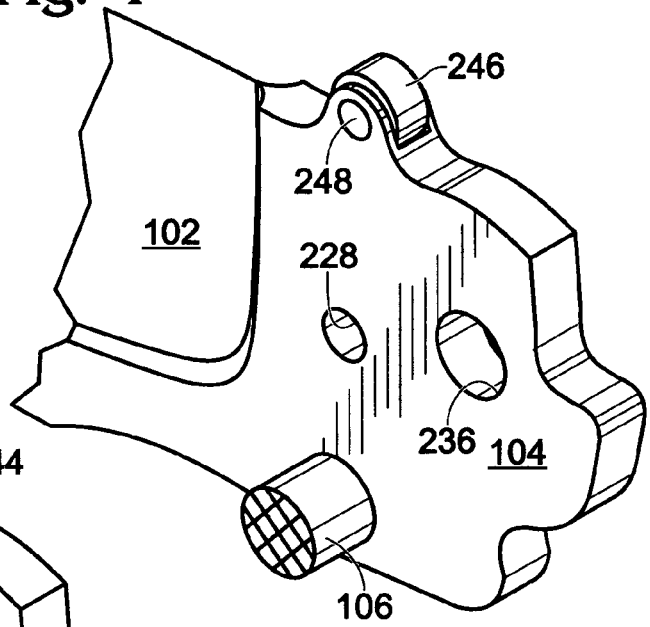
FIG. 4 is an isometric view of the tang portion of FIG. 1 with the roller cam inserted and pinned into position.

FIG. 4 is an isometric view of Tang 104 of Folding Knife 100 of FIG. 1 with Roller Cam 246 inserted and pinned by Keeper Pin 248 into position. When assembled, the outer or rolling surface of Roller Cam 246 extends slightly outside of Lobe 244 thereby keeping the opening and closing activities from damaging Tang 104. Roller Cam 246 is the only contact made by Adjustable Spring 210 during the opening and closing action thereby eliminating the friction and galling created on Tang 104 as the current technology experiences. Unlike the current technology that becomes useless once the opening mechanism is damaged, Roller Cam 246 can be replaced if damaged or worn.

FIG. 5 is an exploded isometric view of the safety assembly of the preferred embodiment of the present invention. Safety Washer 224 fits into Safety Washer Recess 502 on the interior of First Outer Handle 110. Safety Stud 118 on Safety Washer 224 extends through Safety Slot 120. Incline Ramp 504 is the ramp Safety Ball 230 travels along depending upon the movement of Safety Stud 118. When Safety Stud 118 is in the "safe" position, Safety Ball 230 is forced to the top or the shallowest portion of the ramp, thereby forcing Safety Ball 230 through Passage Hole 226 located on First Liner 114 and then lodges firmly into Ball Lock Hole 228 (not shown) on Tang 104 of Blade 102. With Safety Ball 230 in Ball Lock Hole 223, Folding Knife 100 is locked in the "safe" mode and accidental opening is prevented. Folding Knife 100 cannot be opened without releasing the safety. When Adjustable Spring 210 (not shown) is in the automatic opening setting, the releasing of Safety Ball 230 from Ball Lock Hole 223 serves as a release for Blade 102.

In an alternate embodiment, the safety assembly can also be used to secure Blade 102 in the open position by simply placing a second Ball Lock Hole 228 in the proper position on Tang 104. This could be used in conjunction with Safety Spring Portion 204 (see FIG. 2) or Safety Spring Portion 204 could be eliminated.

FIG. 6 is a cross sectional view of the safety assembly of the preferred embodiment of the present invention taken at line 6-6 of FIG. 1 with the Safety Ball 230 in the non-safe position. As can be seen, Safety Ball 230 is protruding slightly through First Liner 114, but not far enough to lodge into Ball Lock Hole 228; therefore, Blade 102 can be moved freely from the closed to the open position. Spacer 222 allows a space for Safety Ball 230 to move through before lodging into Ball Lock Hole 228.

FIG. 7 is a cross sectional view of the safety assembly of the preferred embodiment of the present invention taken at line 6-6 of FIG. 1 with the Safety Ball 210 in the "safe" position. As can be seen, Safety Ball 230 has been forced to travel to the shallowest portion of Incline Ramp 504 by rotation of Safety Washer 224 to the "safe" position. Safety Ball 230 is forced through Passage Hole 226 on First Liner 114 and into Ball Lock Hole 228 on Tang 104.

Figure 8:
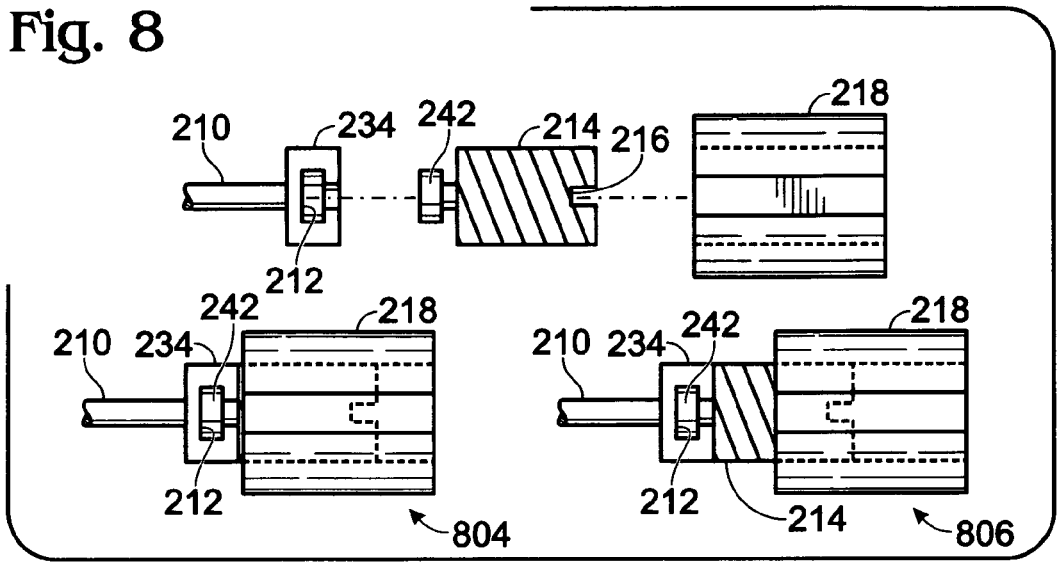
FIG. 8 is a detailed view of the spring adjustment feature of the preferred embodiment of the present invention.

FIG. 8 is a detailed view of the spring adjustment feature of the preferred embodiment of the present invention. The top, exploded view in FIG. 8 shows Spring Base 234 with Receiver Notch 212. In the preferred embodiment, Spring Base 234 is a square shape so that it cannot rotate when Threaded Adjuster 214 is rotated. It has also been contemplated that Spring Base 234 be of an elliptical or rectangular shape. Spring Attach End 242 slips into Receiver Notch 212 from the side. Threaded Adjuster 214 is threaded into Threaded Pillow Block 218. By turning Threaded Adjuster 214 within Threaded Pillow Block 212, Adjustable Spring 210 is set for Folding Knife 100 to operate in the automatic opening mode (Adjustable Spring 210 extended) or by the assisted opening mode (Adjustable Spring 210 retracted). To make these adjustments, Blade 102 must be in the open and locked position relieving pressure from Adjustable Spring 210.

The lower left diagram in FIG. 8 shows Threaded Adjuster 214 in Assisted Open Position 804 where Safety Spring 210 is retracted. The lower right diagram of FIG. 8 shows Threaded Adjuster 214 in Automatic Open Position 805 where Safety Spring 210 is extended.

Figure 9:
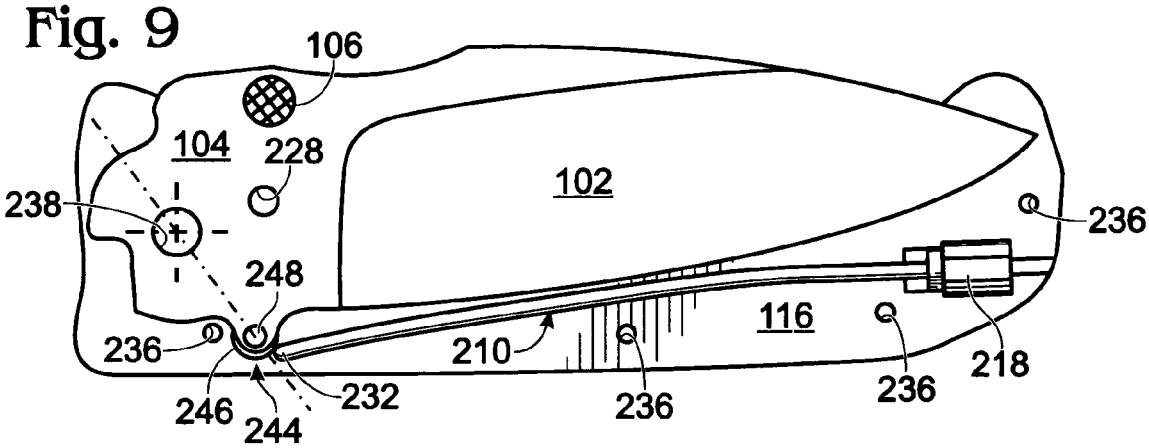
FIG. 9 is a side view of the knife blade and roller cam with the adjustable spring withdrawn to the assisted opening position.

FIG. 9 is a side view of Blade 102 and Roller Cam 246 with Adjustable Spring 210 withdrawn to Assisted Open Position 804. With Spring Distal End 232 retracted to below Keeper Pin 248 of Roller Cam 246, Folding Knife 100 operates in the assisted opening mode. This positioning of Spring Distal End 232 applies closing pressure on Roller Cam 246 until Blade 102 is rotated approximately 10 to 15 degrees from closed. To begin this rotation, the user must urge Blade 102 from the closed position by applying pressure to Opening Stud 106. When Spring Distal End 232 becomes centered with the axis of Roller Cam 246, the closing pressure is changed to an opening pressure and Adjustable Spring 210 forces Blade 102 to the fully open position. As the closed position is approached when closing Blade 102, the closing pressure replaces the opening pressure and the knife is assisted closed. The assisted closure is unique to this design and functions as a safety feature that avoids accidental opening that can happen within the users pocket or hand as is often experienced with the current technology.

Figure 10:
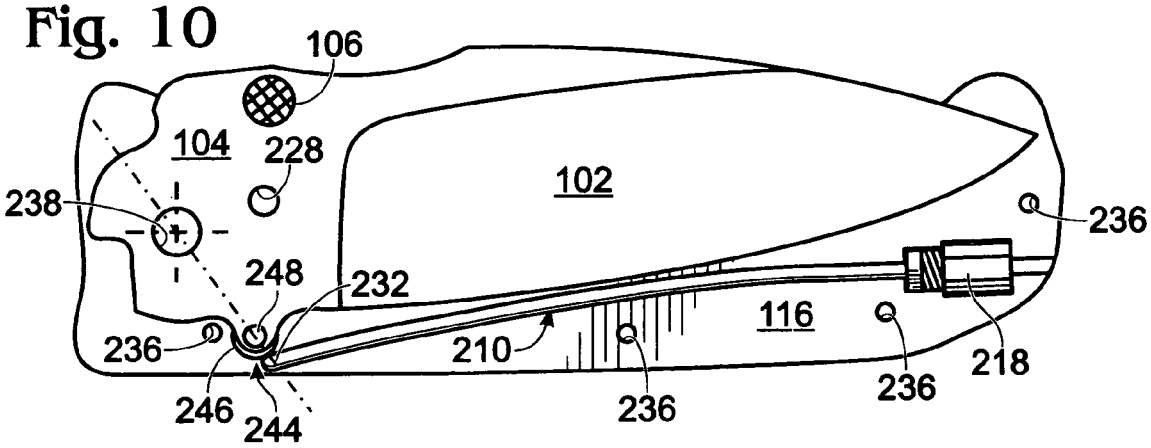
FIG. 10 is a side view of the knife blade and roller cam of the preferred embodiment of the present invention with the adjustable spring inserted to the automatic opening position.

FIG. 10 is a side view of Blade 102 and Roller Cam 246 of the preferred embodiment of the present invention with Spring Distal End 232 of Adjustable Spring 210 extended to Automatic Opening Position 805. In automatic open mode, Spring Distal End 232 is extended beyond the centerline, or axis, of Keeper Pin 248 of Roller Cam 246. This Adjustable Spring 210 position maintains opening pressure on Blade 102 throughout the opening of Folding Knife 100 requiring no assistance from the user beyond the initial release of Blade 102. The user can release Blade 102 by sliding Safety Stud 118 out of safe mode, thereby dislodging Safety Ball 230 (not shown) from Ball Lock Hole 228.

Figure 11:
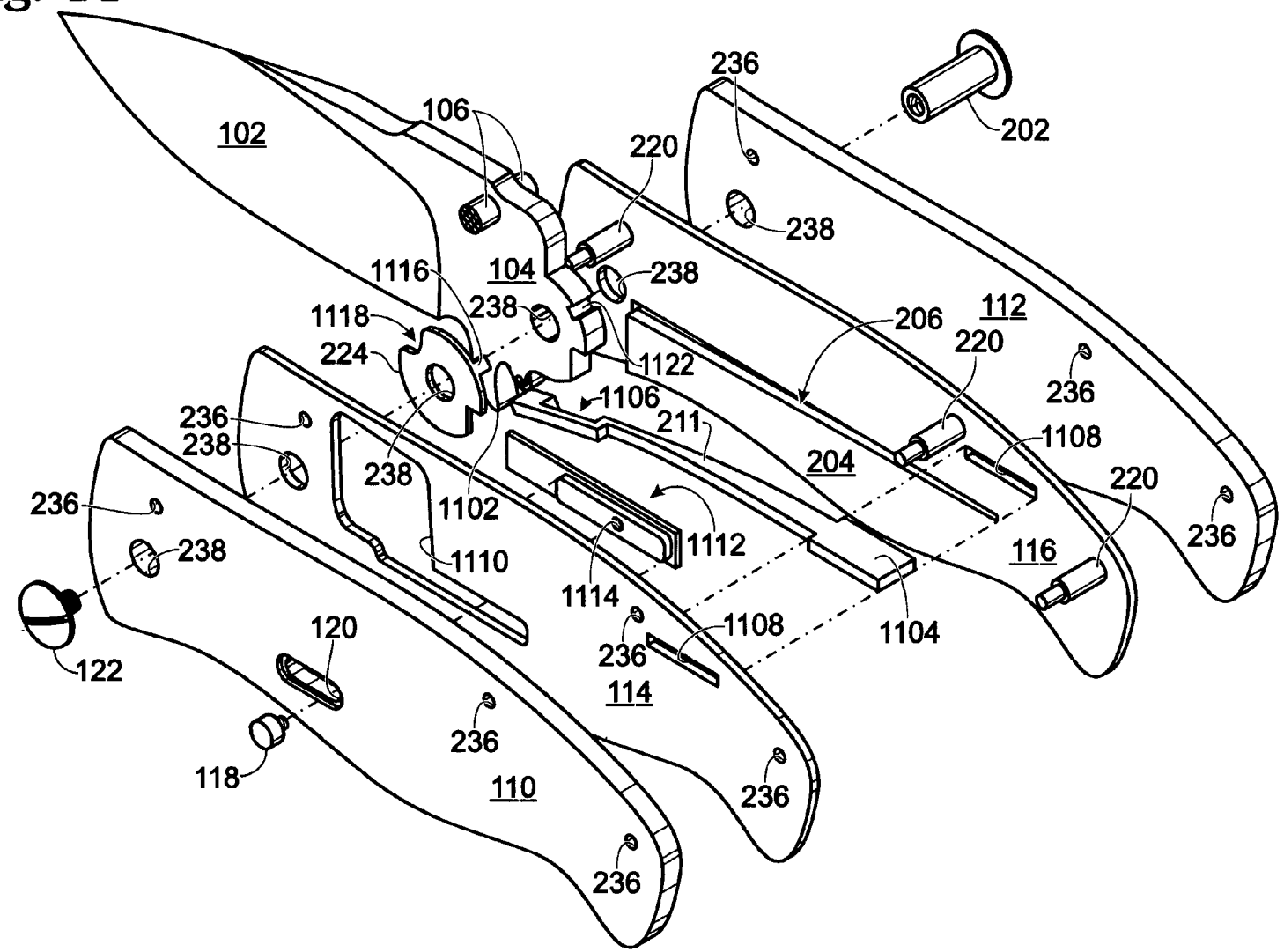
FIG. 11 is an exploded isometric view of an alternate embodiment of the present invention depicting an alternate assisted opening mechanism.

FIG. 11 is an exploded isometric view of an alternate embodiment of the present invention depicting an alternate assisted opening mechanism and safety mechanism. First Outer Handle 110 has a Safety Slot 120 where Safety Stud 118 is installed at Safety Stud Attach Point 1114 and moves Safety Assembly 1112 between safe mode and safe off mode. Safety Assembly 1112 is a lateral sliding safety mechanism that extends through Safety Assembly Cavity 1124 in First Liner 114. In this embodiment, Safety Washer 224 is attached to Tang 104 by inserting Bent Tab 1116 on Safety Washer 224 into Bent Tab Notch 1122 on the outer portion of Tang 104. When Folding Knife 100 is closed, the user contacts Safety Stud 118 to slide Safety Assembly 1112 toward Tang 104 thereby inserting the end of Safety Assembly 1112 into Slide Safety Engagement Notch 1118 on Safety Washer 224.

Safety Washer 224 also has Spring Safety Engagement Notch 1120 to coincide with the relief in Tang 104 for the engagement of Safety Spring Portion 204 that safely holds Folding Knife 100 in the open position. Although this embodiment has Opening Studs 106 for opening and closing Folding Knife 100, the user can also open Folding Knife 100 using Finger Cam 1102 that is a protrusion along the perimeter of Tang 104. Finger Cam 1102 provides easy, one-handed opening of Folding Knife 100.

Alternate Safety Spring 211 has Spring Locator Lug 1104 that is staked or press fitted into Lug Slots 1108 in both First Liner 114 and Second Liner 116. Spring Distal End 232 engages with Roller Cam 246 to assist in the opening and closing of Blade 102. Alternate Safety Spring 211 has Finger Cam Clearance Offset 1106 that sweeps through Spring Cavity 1110 in First Liner 114. Finger Cam Clearance Offset 1106 is necessary to clear Finger Cam 1102 when Tang 104 moves between the opened and the closed positions.

Figure 12:
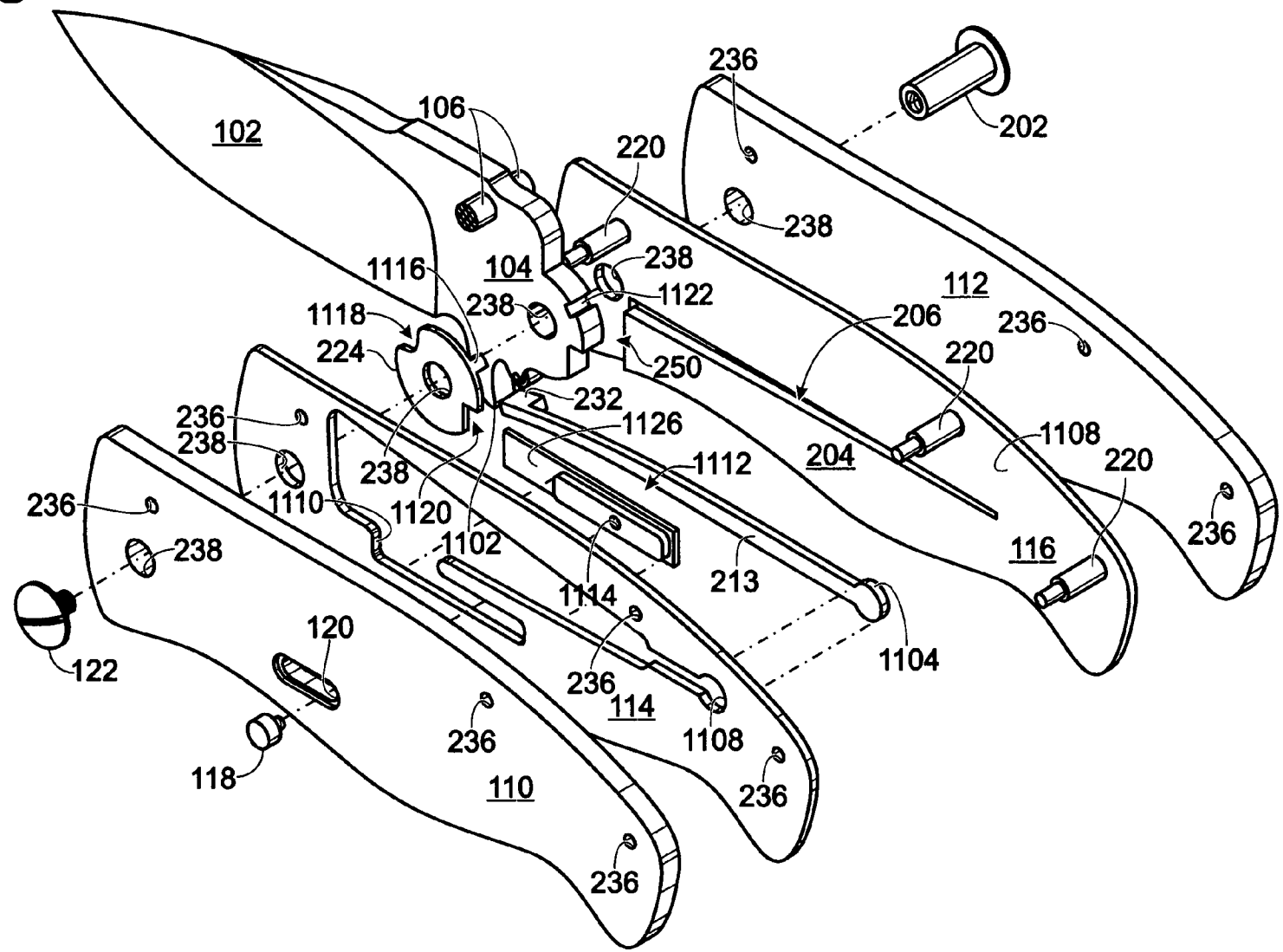
FIG. 12 is an exploded isometric view of another alternate embodiment of the present invention depicting another alternate assisted opening mechanism.

FIG. 12 is an exploded isometric view of another alternate embodiment of the present invention depicting another alternate assisted opening spring mechanism. In this embodiment, Spring Locator Lug 1104 on Second Alternate Spring 213 is press fitted or staked into Lug Slot 1108 located within Spring Cavity 1110. While Spring Distal End 232 travels along Roller Cam 246 during the opening and closing of Folding Knife 100, Second Alternate Spring 213 sweeps through Spring Cavity 1110 of First Liner 114. As described in FIG. 11, Safety Assembly 1112 slides within Spring Cavity 1110 when moving between safety mode and safety off mode.

Figure 13:
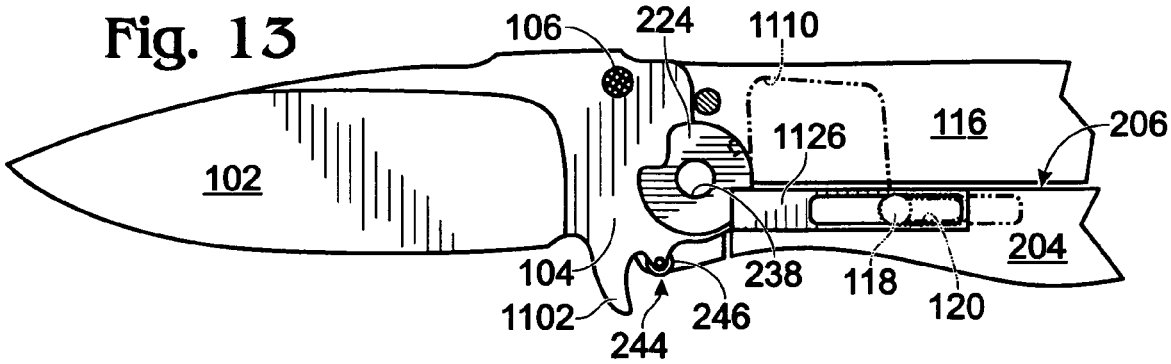
FIG. 13 is a side view of the knife blade in a full open position and an alternate safety assembly in the safety on/open position of an alternate embodiment of the present invention.

FIG. 13 is a side view of Folding Knife 100 in a full open position illustrating Safety Assembly 1112 in the safety on/open position of the alternate embodiments depicted in FIG. 11 and FIG. 12. With Folding Knife 100 in the locked, open position, Spring Assembly 1112 engages with Safety Washer 224 and Safety Spring Portion 204 of Second Liner 116 engages with Tang 104 creating a double safety. It has also been contemplated to eliminate Safety Spring Portion 204 although a double safety may be desirable by some users.

Figure 14:
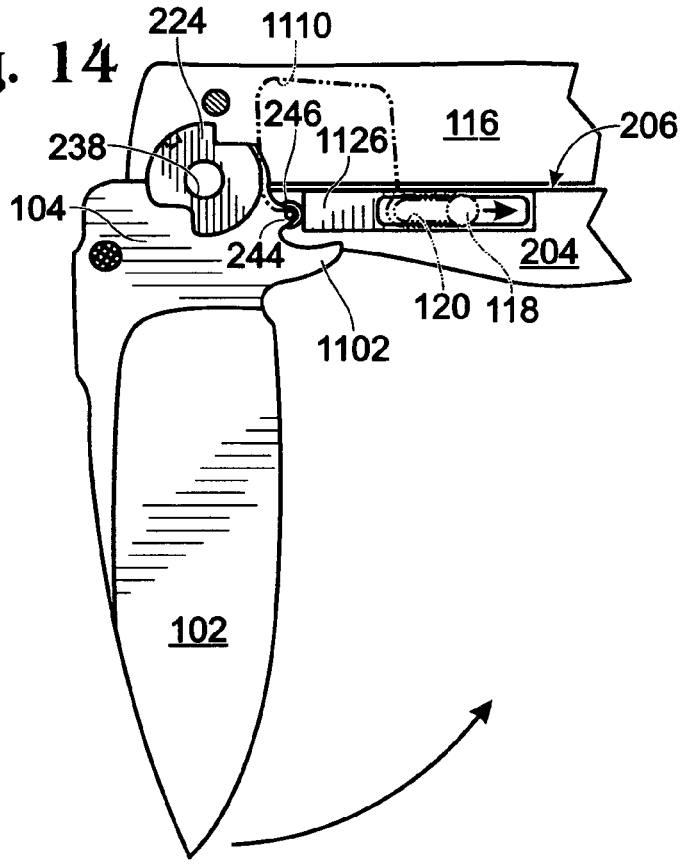
FIG. 14 is a side view of the knife blade in a half closed position and the alternate safety assembly in the safety off position.

FIG. 14 is a side view of Folding Knife 100 in a half closed position and Safety Assembly 1112 in the safety off position. In the safety off position, Safety Assembly 1112 moves out of the way of Finger Cam 1102 as it swing over Safety Engagement End 1126.

Figure 15:
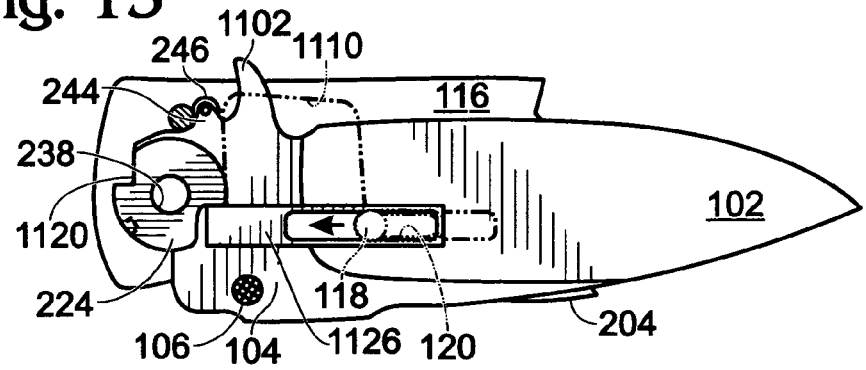
FIG. 15 is a side view of the knife blade in a closed position and the alternate safety assembly in the safety on/closed position.

FIG. 15 is a side view of Folding Knife 100 in a closed position with Safety Assembly 1112 in the safety on/closed position. Safety Assembly 1112 slides toward Tang 104 to engage in Slide Safety Engagement Notch 1118 disabling the rotation or opening of Folding Knife 100.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A low friction folding knife, comprising:

a blade having a distal end and a tang opposite the distal end, the tang having a thickness with a slot disposed in the thickness, a roller cam rotatably attached in the slot by a keeper pin and extending slightly outside of the slot;

a handle having a first outer handle and a second outer handle spaced apart and parallel creating a blade slot for receiving the blade when the folding knife is folded to a closed position, the blade being pivotally attached to the handle at the tang with a pivot bolt;

a safety assembly disposed within the first outer handle adjacent to the blade slot having a safety stud extending through a safety slot in the first outer handle, the safety stud enables movement of the safety assembly by a user between a safe position and a safe off position; and an adjustable bias element disposed between the first outer handle and the second outer handle, the adjustable bias element configured to assist the folding knife to an open position, the adjustable bias element having an adjustment end and a spring distal end, the spring distal end is in spring communication with the roller cam on the tang, the adjustment end having a screw adjustment that extends and retracts the spring distal end;

wherein, the safety assembly in the safe position forces the safety assembly against the tang of the blade preventing opening of the blade, the spring distal end of the adjustable bias element when extended applies an opening pressure to the roller cam thereby automatically opening the blade when the safety assembly is in the safe off position, the spring distal end when retracted applies the opening pressure to the roller cam and assists the blade to the open position only after the user initiates opening by pulling the blade slightly from the blade slot.

2. The low friction folding knife of claim 1, wherein the handle further comprises a first liner parallel and attached to the first outer handle and a second liner parallel and attached to the second outer handle, the blade slot disposed between the first liner and the second liner.

3. The low friction folding knife of claim 2, wherein the adjustment end of the adjustable bias element, further comprises:

a receiver notch on the adjustment end;

a threaded adjuster having a receiver end and a screw driver end;

a threaded pillow block fixedly attached between the first liner and the second liner opposite the pivot bolt having a spring end and an open end;

wherein, the threaded adjuster is screwed into the threaded pillow block and the receiver end is rotatably coupled to the receiver notch of the adjustment end of the adjustable bias element such that a screw driver inserted through the open end of the threaded pillow block adjusts the threaded adjuster by engaging the screw driver end and turning clockwise, thereby only the threaded adjuster rotates and extends the spring distal end closer to the roller cam, and turning the threaded adjuster counter clockwise retracts the spring distal end.

4. The low friction folding knife of claim 3, wherein the safety assembly is disposed between the first outer handle and the first liner; and further comprises:

a slotted ramp adjacent to the first liner, the slotted ramp having a deep ramp end and a shallow ramp end; and a safety ball;

wherein, the safety ball is forced to the shallow ramp end when in the safe position thereby forcing the safety ball through a hole in the first liner and lodging the safety ball into a ball lock hole disposed in the tang of the blade thereby locking the blade in the closed position, and in the safe off position, the safety ball is moved to the deep ramp end thereby releasing the safety ball from the ball lock hole allowing the blade rotate to the open position.

5. The low friction folding knife of claim 4, wherein the safety assembly is round and rotates between the safe position and the safe off position.

6. The low friction folding knife of claim 4, wherein the safety ball is hardened tool steel.

7. The low friction folding knife of claim 4, wherein the safety ball is ceramic.

8. The low friction folding knife of claim 1, wherein the roller cam is hardened tool steel.

9. The low friction folding knife of claim 1, wherein the roller cam is ceramic.

10. A low friction folding knife, comprising:

a blade having a distal end and a tang, the tang having a thickness with a slot disposed in the thickness, a roller cam rotatably attached in the slot by a keeper pin inserted perpendicular to the slot and the roller cam extending slightly from the slot;

a handle having a first outer handle parallel and attached to a first liner, a second outer handle parallel and attached to a second liner, the first liner and the second liner spaced apart and parallel creating a blade slot for receiving the blade when the folding knife in a closed position, the blade being pivotally coupled to the handle with a pivot bolt;

a safety assembly disposed within the first outer handle and held in place by the first liner having a safety stud extending through a safety slot disposed in the first outer handle for moving the safety assembly between a safe position and a safe off position, the safety assembly in the safe position forces a safety ball through a hole in the first liner and into a ball lock hole disposed in the tang of the blade thereby preventing rotation to an open position, the safety assembly in the safe off position removes force from the safety ball allowing the blade to rotate to the open position; and an adjustable bias element disposed between the first liner and the second liner, the adjustable bias element configured to assist the blade in exiting the blade slot, the adjustable bias element having an adjustment end and a spring distal end, the spring distal end is in spring communication with the roller cam on the tang, the adjustment end having a screw adjustment that extends and contracts the spring distal end;

wherein, the adjustable bias element when retracted and the folding knife is in the closed position the spring distal end applies a closing pressure to the roller cam holding the blade in the closed position, and the adjustable bias element assisting the blade to an open position only after a user initiates opening by pulling the blade slightly from the blade slot wherein the opening pressure replaces the closing pressure as the spring distal end moves around the roller cam, the closing pressure assists closing and holds the blade in the closed position wherein the spring distal end of the adjustable bias element when extended applies an opening pressure to the roller cam thereby automatically opening the blade when the safety assembly is in the safe off position.

11. The low friction folding knife of claim 10, wherein the safety ball is hardened tool steel.

12. The low friction folding knife of claim 10, wherein the safety ball is ceramic.

13. The low friction folding knife of claim 10, wherein the roller cam is hardened tool steel.

14. The low friction folding knife of claim 10, wherein the roller cam is ceramic.

15. The low friction folding knife of claim 10, wherein the safety assembly further comprises:

a slotted ramp adjacent to the first liner, the slotted ramp having a deep ramp end and a shallow ramp end;

wherein, the safety ball is forced to the shallow ramp end when the safety stud is moved to the safe position thereby forcing the safety ball through the hole in the first liner and lodging it into the ball lock hole in the tang of the blade thereby locking the blade closed, and when the safety stud is moved to the safe off position, the safety ball is forced to the deep ramp end thereby releasing the safety ball from the ball lock hole allowing the blade to open.

16. The low friction folding knife of claim 10, further comprising a second ball lock hole in the tang of the blade such that when the blade is fully open and the safety stud is moved to the safe position, the safety ball is forced into the shallow ramp end of the slotted ramp forcing the safety ball through the hole in the first liner and lodging it into the second ball lock hole in the tang of the blade thereby locking the blade open.

* * * * *